US007879773B2

(12) United States Patent
Zakarian et al.

(10) Patent No.: US 7,879,773 B2
(45) **Date of Patent: *Feb. 1, 2011**

(54) LUBRICATING COMPOSITION HAVING IMPROVED STORAGE STABILITY

(75) Inventors: John A. Zakarian, Hercules, CA (US); Michael J. Haire, Petaluma, CA (US)

(73) Assignee: Chevron U.S.A., Inc., San Ramon, CA (US)

( * ) Notice: Subject to any disclaimer, the term of this patent is extended or adjusted under 35 U.S.C. 154(b) by 985 days.

This patent is subject to a terminal disclaimer.

(21) Appl. No.: 11/122,463

(22) Filed: May 4, 2005

(65) Prior Publication Data

US 2006/0252657 A1 Nov. 9, 2006

(51) Int. Cl.

| | |
|---|---|
| ***C10M 141/10*** | (2006.01) |
| ***C10M 173/02*** | (2006.01) |
| ***C10M 135/04*** | (2006.01) |
| ***C10M 137/04*** | (2006.01) |
| ***C10M 135/22*** | (2006.01) |

(52) U.S. Cl. ..... 508/159; 508/156; 508/322; 508/433; 508/441; 508/569

(58) Field of Classification Search ..... 508/159, 508/156, 569, 441, 442, 433, 322
See application file for complete search history.

(56) References Cited

U.S. PATENT DOCUMENTS

| | | | | |
|---|---|---|---|---|
| 2,208,163 | A | 7/1940 | Prutton et al. | |
| 3,313,727 | A | 4/1967 | Peeler | |
| 3,565,802 | A | 2/1971 | West et al. | |
| 3,819,521 | A | 6/1974 | Sims | |
| 3,846,313 | A | 11/1974 | Sims | |
| 3,853,772 | A | 12/1974 | Adams | |
| 3,907,601 | A | 9/1975 | Schaefer | |
| 3,907,691 | A | 9/1975 | King et al. | |
| 3,912,639 | A | 10/1975 | Adams | |
| 3,912,643 | A | 10/1975 | Adams | |
| 3,912,644 | A | 10/1975 | Adams | |
| 3,997,454 | A | 12/1976 | Adams | |
| 4,089,790 | A | 5/1978 | Adams | |
| 4,171,268 | A | 10/1979 | Collins | |
| 4,204,969 | A | 5/1980 | Papay et al. | |
| 4,459,215 | A | 7/1984 | Salentine | |
| 4,563,302 | A | 1/1986 | Griffin et al. | |
| 4,575,431 | A | 3/1986 | Salentine | |
| 6,489,271 | B1 * | 12/2002 | Richardson | 508/186 |
| 6,689,723 | B2 * | 2/2004 | Sullivan et al. | 508/185 |
| 2004/0214729 | A1 * | 10/2004 | Buitrago | 508/272 |

* cited by examiner

*Primary Examiner*—Glenn A Caldarola
*Assistant Examiner*—Vishal Vasisth
(74) *Attorney, Agent, or Firm*—Penny L. Prater

(57) ABSTRACT

A lubricating oil composition having superior storage stability and load-carrying effect is disclosed. The composition comprises four components: (1) an alkali metal borate; (2) an oil-soluble sulfur compound; (3) a trialkyl hydrogen phosphite; and (4) a mixture of greater than 50% neutralized acidic phosphates that are essentially free of monothiophosphates.

8 Claims, No Drawings

LUBRICATING COMPOSITION HAVING IMPROVED STORAGE STABILITY

BACKGROUND OF THE INVENTION

The invention relates to extreme pressure lubricating oils, particularly alkali metal borate-containing lubricants.

Alkali metal borates are well known in the lubricant industry for their usefulness as extreme pressure agents. See, for example, U.S. Pat. Nos. 3,313,727; 3,565,802; 3,819,521; 3,846,313; 3,853,772; 3,907,691; 3,912,639; 3,912,643; 3,912,644; 3,997,454; and 4,089,790.

U.S. Pat. No. 4,459,215 discloses a lubricating composition containing an alkali metal borate, a sulfur-containing compound and a zirconium salt.

U.S. Pat. No. 4,575,431 discloses a lubricating oil containing a mixture of phosphates, said phosphates being essentially free of monothiophosphates.

U.S. Pat. No. 4,089,790 claims a synergistic lubricant mixture containing: (1) a hydrated potassium borate; (2) an anti-wear agent selected from (a) zinc dihydrocarbyl dithiophosphate, (b) $C_1$ to $C_{20}$ ester, $C_1$ to $C_{20}$ amide or $C_1$ to $C_{20}$ amine salt of a dihydrocarbyl dithiophosphoric acid, (c) zinc alkyl aryl sulfonate, and (d) mixture thereof; and (3) oil soluble antioxidant organic sulfur compound.

U.S. Pat. No. 4,171,268 claims lubricant compositions containing a zirconium salt of a carboxylic acid and oil-soluble sulfur-containing extreme pressure agent.

U.S. Pat. Nos. 4,563,302 and 4,204,969 disclose sulfurized olefins useful in lubricating oils.

U.S. Pat. No. 4,717,490 to Salentine discloses a lubricating composition that is a combination of alkali metal borates, sulfur compounds, phosphites, and >50% neutralized acidic phosphates. However, this composition suffers from a shortened shelf life compared to other commercially available lubricants, which do not use solid dispersions of alkali metal borates. In particular, this composition will exhibit additive "dropout" over time. The problem becomes more severe as the storage temperature increases. The standard remedy in the industry is to add more dispersant or detergent additives to the composition to improve the shelf life. However, these additives can negatively impact other performance properties of the gear lubricant. It is, therefore, an object of the present invention to provide an alkali metal borate-containing lubricant which has superior load carrying properties and improved storage stability.

Without being bound to any specific theory, we have found that a major cause of additive dropout is the use of the dialkyl hydrogen phosphite, which is disclosed as an essential component of the combination in the Salentine patent. This material is acidic and unstable, and it appears to react with either the borate particles or with the basic dispersant and/or detergent additives that are used to stabilize the borate particles to generate a precipitate which settles to the bottom of a lubricant container or package. The acidity derives from a hydrogen that is either directly attached to a phosphorus or attached to a hetero atom which is in turn attached to a phosphorus. The present invention involves replacing the dialkyl hydrogen phosphite of the Salentine patent with a trialkyl phosphite. The trialkyl phosphite is not as reactive and the storage stability of the resultant composition improves unexpectedly and dramatically.

The Salentine patent claimed that there was a synergistic load-carrying effect obtained from combining four components. This improved load-carrying effect is preserved even when the dialkyl hydrogen phosphite is replaced by trialkyl phosphite in accordance with the present invention.

Another benefit of a composition in accordance with the present invention is that it is much easier to manufacture compared to the compositions disclosed in the Salentine patent. Dialkyl hydrogen phosphite is a solid material and is very difficult to handle during blending at the plant. Because of its reactivity and sensitivity to water, full containers of the chemical must be used. On the other hand, trialkyl phosphite is liquid at room temperature and so blending is very easy. It also exhibits much less reactivity to water.

SUMMARY OF THE INVENTION

The present invention relates to a lubricating composition comprising an oil of lubricating viscosity having dispersed therein a minor amount of a mixture of:

(a) a hydrated alkali metal borate component;

(b) an oil-soluble sulfur-containing compound component;

(c) a trialkyl hydrogen phosphite component, at least 90 wt. % of which has the formula $(RO)_3$ P, where R is alkyl of 4 to 24 carbon atoms; and (d) a mixture of greater than 50% neutralized acidic phosphates component, said phosphates being essentially free of monothiophosphates.

DESCRIPTION OF THE PREFERRED EMBODIMENTS

The lubricating oil composition of the present invention comprises four components: (1) an alkali metal borate; (2) an oil-soluble sulfur compound; (3) a trialkyl hydrogen phosphite; and (4) a mixture of greater than 50% neutralized acidic phosphates that are essentially free of monothiophosphates.

The Alkali-Metal Borates

The first component of a lubricating oil composition of the invention is a hydrated particulate alkali metal borate. The hydrated particulate alkali metal borates are well known in the art and are available commercially. Representative patents disclosing suitable borates and methods of manufacture include U.S. Pat. Nos. 3,313,727; 3,819,521; 3,853,772; 3,907,601; 3,997,454; and 4,089,790, the entire disclosures of which are incorporated herein by reference.

The hydrated alkali metal borates can be represented by the following formula:

$$M_2O.mB_2O_3.nH_2O$$

where M is an alkali metal of atomic number in the range 11 to 19, i.e., sodium and potassium; m is a number from 2.5 to 4.5 (both whole and fractional); and n is a number from 1.0 to 4.8. Preferred are the hydrated potassium borates, particularly the hydrated potassium triborates microparticles having a boron-to-potassium ratio of about 2.5 to 4.5. The hydrated borate particles generally have a mean particle size of less than 1 micron.

The Oil-Soluble Sulfur Compounds

The second component of a lubricating oil composition of the invention is at least one oil-soluble sulfur-containing compound. Any of the known types of organic sulfur compounds which have heretofore been suggested as being useful as extreme pressure agents may be used as a sulfur-containing agent in the invention. These include organic sulfides and polysulfides, sulfurized oils and esters or fatty acids, and mixtures thereof. These sulfur compounds may contain other groups which are beneficial and these include halogen groups.

Examples of organic sulfides and polysulfides which are useful as EP agents include aliphatic and aromatic sulfides and polysulfides such as hexyl sulfide, octadecyl sulfide, butyl disulfide, amyl disulfide, hexyl disulfide, octadecyl disulfide, diphenyl sulfide, dibenzyl sulfide, dixylyl sulfide, diphenyl disulfide, dinaphthyl disulfide, diphenol disulfide, dibenzyl disulfide, bis(-chlorobenzyl) disulfide, dibenzyl trisulfide, dibutyltetrasulfide, sulfurized dipentene and sulfurized terpene.

A preferred class of sulfur-containing additives are those made by reacting sulfur and/or sulfur monochloride with an olefin such as isobutylene. Particularly preferred are the sulfurized olefins disclosed in U.S. Pat. Nos. 4,563,302 and 4,204,969, the disclosures of which are incorporated herein by reference.

Halogenated derivatives of the above sulfides and polysulfides are useful and examples include the chlorinated and fluorinated derivatives of diethyl sulfide and disulfide, dioctyl sulfide, diamyl sulfide and disulfide, diphenyl sulfide and disulfide, and dibenzyl sulfide and disulfide. A more exhaustive listing of sulfur and halogen EP agents which may be used is found in U.S. Pat. No. 2,208,163. Examples of sulfurized oils include sulfurized sperm oil, sulfurized methyl ester of oleic acid, sulfurized sperm oil replacements. Other examples of sulfurized oils include sulfurized methyl linoleate, sulfurized animal and vegetable oils, sulfurized lard oil, and sulfurized cottonseed oil.

The Phosphites

The third component of a lubricating oil of the invention is a trialkyl phosphite. Trialkyl phosphites useful in the present invention include $(RO)_3$ P where R is a hydrocarbyl of about 4 to 24 carbon atoms, more preferably about 8 to 18 carbon atoms, and most preferably about 10 to 14 carbon atoms. The hydrocarbyl may be saturated or unsaturated. Preferably, the trialkyl phosphite contains at least 90 wt. % of the structure $(RO)_3$ P wherein R is as defined above. Representative trialkyl phosphites include, but are not limited to, tributyl phosphite, trihexyl phosphite, trioctyl phosphite, tridecyl phosphite, trilauryl phosphite and trioleyl phosphite. A particularly preferred trialkyl phosphite is trilauryl phosphite, such as commercially available Duraphos TLP by Rhodia Incorporated Phosphorus and Performance Derivatives or commercially available Doverphos 53 (TLP) by Dover Chemical Corporation. Such trialkyl phosphates may contain small amounts of dialkyl phosphites as impurities, in some cases as much as 5 wt. %. Preferred are mixtures of phosphites containing hydrocarbyl groups having about 10 to 20 carbon atoms. These mixtures are usually derived from animal or natural vegetable sources. Representative hydrocarbyl mixtures are commonly known as coco, tallow, tall oil, and soya.

The Neutralized Phosphates

The fourth component of the lubricating oil of the present invention is a mixture of neutralized phosphates. This mixture is disclosed in U.S. Pat. No. 4,575,431, which is incorporated herein by reference. This component comprises a mixture of phosphates, said phosphates being essentially free of monothiophosphates and comprising: (a) dihydrocarbyl hydrogen dithiophosphates; and (b) a sulfur-free mixture of hydrocarbyl dihydrogen phosphates and dihydrocarbyl hydrogen phosphates said composition being at least 50% neutralized by a hydrocarbyl amine having 10 to 26 carbon atoms in said hydrocarbyl group.

As used in the present application the term "essentially free of monothiophosphates" means that the lubricant or lubricant additive does not contain any monothiophosphates that are materially detrimental to the extreme pressure properties of the lubricant. Preferably the lubricant or lubricant additive of the present invention contains no monothiophosphates whatsoever.

Each of the individual components of the phosphates used to make the mixture of neutralized phosphates is well known in the art.

The Dithiophosphates

Typical dithiophosphates are those containing two hydrocarbyl groups and one hydrogen functionality, and are therefore acidic. The hydrocarbyl groups useful herein are preferably aliphatic alkyl groups of 3 to 8 carbon atoms.

Representative dihydrocarbyl dithiophosphates include: di-2-ethyl-1-hexyl hydrogen dithiophosphate, diisoctyl hydrogen dithiophosphate, dipropyl hydrogen dithiophosphate and di-4-methyl-2-pentyl hydrogen dithiophosphate.

Preferred dithiophosphates are dihexyl hydrogen dithiophosphate, dibutyl hydrogen dithiophosphate, and di-n-hexyl hydrogen dithiophosphate.

The Sulfur-Free Phosphates

Typical non-sulfur-containing phosphates include the dihydrocarbyl hydrogen phosphates and the monohydrocarbyl dihydrogen phosphates where the hydrocarbyl will contain 1 to 10 carbon atoms, and preferably 3 to 5 carbon atoms, and most preferably 4 carbon atoms. The hydrocarbyl is an aliphatic alkyl group.

Representative phosphates include: methyl dihydrogen phosphate, propyl dihydrogen phosphate, butyl dihydrogen phosphate, dibutyl hydrogen phosphate; dipentyl hydrogen phosphate; pentyl dihydrogen phosphate; hexyl dihydrogen phosphate, decyl dihydrogen phosphate, and the like.

Preferred is a mixture of dibutyl hydrogen phosphate, and butyl dihydrogen phosphate.

Neutralization of the Phosphates with Amines

The mixture of acidic phosphates is partially or completely neutralized by reaction with alkylamines. The resulting composition is a complex mixture of alkylammonium salts, mixed acid-alkylammonium salts and acids of the sulfur-free mono and dihydrocarbyl phosphates and alkylammonium salts and free acids of the dihydrocarbyl dithiophosphates. Neutralization must be at least 50%, preferably at least 80% complete. For best results, neutralization should be in the range of 85% to 95%, wherein 100% neutralization refers to the reaction of one alkylamine with each acid hydrogen atom.

The amine alkyl group is from 10 to 30 carbon atoms, preferably 12 to 18 carbon atoms in length. Typical amines include pentadecylamine, octadecylamine, cetylamine, and the like. Most preferred is oleylamine. The mole ratio of the dithiophosphates to the sulfur-free phosphates should be in the range of 70:30 to 30:70, preferably 55:45 to 45:55 and most preferably 1:1. The mole ratio of the substituted dihydrogen phosphates to the disubstituted hydrogen phosphates should be in the range 30:70 to 55:45, preferably 35:65 to 50:50 and most preferably 45:55.

The Lubricating Oil and Concentration of Additives

The lubricating oil to which the borates, sulfur compounds, phosphites and phosphates are added, can be any hydrocarbon-based lubricating oil or a synthetic-base oil stock. The hydrocarbon lubricating oils may be derived from synthetic or natural sources and may be paraffinic, naphthenic or asphaltic base, or mixtures thereof. The lubricating oil is used in the lubricant composition and the concentrate to make up 100 weight by weight.

The alkali-metal borate will generally comprise 0.1 to 20 wt. % of the lubricant composition, preferably 0.5 to 15.0 wt. %, and more preferably 2.0 to 9.0 wt. %. The oil-soluble sulfur compounds will comprise 0.1 to 10.0 wt. % of the lubricant composition, preferably 0.5 to 4.0 wt. %, and more preferably 1.0 to 3.0 wt. %. The phosphites will comprise 0.01 to 10.0 wt. % of the lubricant composition, preferably 0.05 to 5.0 wt. %, and more preferably 0.10 to 1.0 wt. %. The phosphates will comprise 0.03 to 3.0 wt. % of the lubricant composition, preferably 0.07 to 1.5 wt. %, and more preferably 0.15 to 0.9 wt. %.

The lubricating composition described above can be made by addition of a concentrate to a lubricating base oil. Generally, the lubricant will contain 1.0 to 10.0 wt. % of the concentrate and preferably 5.0 to 8.0 wt. % of the concentrate.

Other Additives

A variety of other additives can be present in lubricating oils of the present invention. These additives include antioxidants, viscosity index improvers, dispersants, rust inhibitors, foam inhibitors, corrosion inhibitors, other antiwear agents, demulsifiers, friction modifiers, pour point depressants and a variety of other well-known additives. Preferred dispersants include the well known succinimide and ethoxylated alkylphenols and alcohols. Particularly preferred additional additives are the oil-soluble succinimides and oil-soluble alkali or alkaline earth metal sulfonates.

EXAMPLES

The following Examples are illustrative of the present invention, but are not intended to limit the invention in any way beyond what is contained in the claims which follow.

Examples 1-2

Table 1 shows two different methods for preparing an additive mixture to be used in the manufacture of an extreme-pressure lubricating oil. Example 1 is an additive package prepared in accordance with the teachings of U.S. Pat. No. 4,717,490. Example 2 is an additive package prepared in accordance with the teachings of the present invention. The only difference between the two preparations is that Example 1 uses the dialkyl hydrogen phosphite whereas Example 2 uses a trialkyl phosphite, specifically trilauryl phosphite. The formulation weight percents of the phosphites in each Example have been adjusted to give equal contributions of phosphorus to the final lubricating oil blend.

Table 1 also displays the results of storage stability tests for the additive packages. The storage stability test is conducted by placing the additive sample into a 4-ounce clear glass bottle and then letting the bottle remain undisturbed on a laboratory shelf (for data at 20° C.) or in a laboratory oven (for data at 66° C.). Periodically, the sample is inspected for its visual appearance with a bright light. The amount of floc or haze in the sample and the amount of sediment at the bottom of the bottle are noted. The storage stability is deemed excellent if no sediment is noted at the bottom of the sample bottle.

A surprising discovery of this invention is that Example 2 has much better storage stability than Example 1. The indication ">19 weeks" for Example 2 means that the storage test was terminated at the end of 19 weeks. Thus, at room temperature storage, Example 2 is far superior to Example 1, which formed heavy sediment after just 1 week. The superior storage results for Example 2 also extend to the accelerated storage conditions at 66° C.

TABLE 1

Composition and Stability of Additive Packages (components in wt. %)

| Components | Example 1 | Example 2 |
|---|---|---|
| Potassium triborate dispersion | 46.2 | 46.2 |
| Sulfurized isobutylene | 30.8 | 30.8 |
| Neutralized amine phosphate mixture | 6.9 | 6.9 |
| Dialkyl hydrogen phosphite | 4.6 | 0 |
| Trialkyl phosphite | 0 | 5.0 |
| Corrosion inhibitors | 3.9 | 3.9 |
| Succinimide dispersant | 1.6 | 1.6 |
| Calcium sulfonate detergent | 0.7 | 0.7 |
| Foam Inhibitor | 0.5 | 0.5 |
| Diluent oil | 4.9 | 4.5 |
| Total wt. % | 100.00 | 100.00 |
| Storage Stability | | |
| Time to heavy sediment @ 20° C. | 1 week | >19 weeks |
| Time to heavy sediment @ 66° C. | 1 week | 4 weeks |

Examples 3-6

Table 2 shows the formulations of extreme-pressure lubricating oils using the additives of either Example 1 or Example 2. Examples 3 and 4 are lubricating oils with the same viscosity at 100° C. and they would be expected to display the same extreme-pressure properties and storage stability. However, the data in Table 2 show an unexpectedly huge improvement in storage stability for the oil of Example 4, made with the trilauryl phosphite-containing additive. There is no difference in extreme pressure performance, as measured by ASTM Method D 2783, between the oils of Example 3 and Example 4.

Table 2 also shows Examples 5 and 6, which are oils with the same viscosity at 100° C., although at a much higher viscosity level than for Examples 3 and 4. The oils of Examples 5 and 6 are blended slightly below the SAE viscosity rating of 85W-140 and the oils of Examples 3 and 4 are blended slightly below the SAE viscosity rating of 80W-90. Again, the Example made with the trialkyl phosphite (Example 6) shows an unexpectedly huge improvement in storage stability compared to the Example made with the dialkyl phosphite (Example 5). The improvement in storage stability comes with no loss in extreme pressure performance.

TABLE 2

Composition and Properties of Finished Lubricants (components in wt. %)

| Components | Example 3 | Example 4 | Example 5 | Example 6 |
|---|---|---|---|---|
| Chevron 600R Base Oil | 81.46 | 81.46 | 19.71 | 19.71 |
| Citgo 150 Bright Stock | 11.58 | 11.58 | 73.19 | 73.19 |
| Example 1 Additive Package | 6.50 | | 6.50 | |
| Example 2 Additive Package | | 6.50 | | 6.50 |

TABLE 2-continued

| Composition and Properties of Finished Lubricants (components in wt. %) | | | | |
|---|---|---|---|---|
| Components | Example 3 | Example 4 | Example 5 | Example 6 |
| Pour point depressant | 0.40 | 0.40 | 0.3 | 0.3 |
| Dispersants | | | 0.24 | 0.24 |
| Corrosion inhibitor | 0.04 | 0.04 | 0.04 | 0.04 |
| Foam inhibitor | 0.02 | 0.02 | 0.02 | 0.02 |
| Total wt. % | 100.00 | 100.00 | 100.00 | 100.00 |
| Properties | | | | |
| Viscosity @ 40° C., cSt | 104.9 | 104.3 | 310.6 | 303.7 |
| Viscosity @ 100° C., cSt | 12.13 | 12.15 | 23.93 | 23.81 |
| Viscosity Index | 106 | 107 | 97 | 99 |
| Four Ball EP Test (D 2783) | | | | |
| Load Wear Index | 51.95 | 52.38 | 58.58 | 57.54 |
| Last non-seizure load, kg | 126 | 126 | 100 | 100 |
| Weld Point, kg | 200 | 200 | 315 | 315 |
| Storage Stability | | | | |
| Time to heavy sediment @ 66° C. | 5 weeks | >11 weeks | 3 weeks | >11 weeks |
| Time to heavy sediment @ 121° C. | 77 hours | >100 hours | 26 hours | >100 hours |

There are numerous variations on the present invention which are possible in light of the teachings and supporting examples described herein. It is therefore understood that within the scope of the following claims, the invention may be practiced otherwise than as specifically described or exemplified herein.

What is claimed is:

1. A lubricating composition with enhanced storage stability comprising:

(a) at least 85 wt % of a base oil of lubricating viscosity; and (b) no more than about 12 wt % of an additive concentrate, said additive concentrate consisting essentially of:

(i) from about 20 to about 60 wt % of hydrated alkali metal triborate dispersion;

(ii) from about 10 to about 50 wt % of an oil-soluble sulfur compound;

(iii) from about 4 to 12 wt % of neutralized amine phosphate, said phosphates being essentially free of monothiophosphates (iv) from about 2 to 12 wt % of trialkyl phosphite, at least 90 wt % of which has the formula $(RO)_3P$, where R is alkyl of 4 to 20 carbon atoms.

2. A lubricating oil concentrate consisting essentially of:

(a) from about 20 to about 60 wt % of hydrated alkali metal triborate dispersion;

(b) from about 10 to about 50 wt % of an oil-soluble sulfur compound, preferably a dialkyl polysulfide;

(c) from about 4 to about 12 wt % of neutralized amine phosphate;

(d) from about 2 to about 12 wt % of trialkyl phosphite, at least 90 wt % of which has the formula $(RO)_3P$, where R is alkyl of 4 to 20 carbon atoms.

3. The composition of claim 1, wherein the oil-soluble sulfur compound is a dialkyl polysulfide.

4. The composition of claim 1, wherein the neutralized amine phosphate is essentially free of monothiophosphates.

5. The composition of claim 1, at least 90 wt % of which has the formula $(RO)_3P$, where R is alkyl of 4 to 20 carbon atoms.

6. The concentrate of claim 2, wherein the oil-soluble sulfur compound is a dialkyl polysulfide.

7. The concentrate of claim 2, wherein the neutralized amine phosphate is essentially free of monothiophosphates.

8. The concentrate of claim 2, at least 90 wt % of which has the formula $(RO)_3P$, where R is alkyl of 4 to 20 carbon atoms.

* * * * *